US011274382B2

(12) United States Patent
Podhajny et al.

(10) Patent No.: US 11,274,382 B2
(45) Date of Patent: Mar. 15, 2022

(54) THREE-DIMENSIONAL FABRIC WITH EMBEDDED INPUT-OUTPUT DEVICES

(71) Applicant: Apple Inc., Cupertino, CA (US)

(72) Inventors: Daniel A. Podhajny, San Jose, CA (US); James G. Griffin, II, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 652 days.

(21) Appl. No.: 15/512,530

(22) PCT Filed: Sep. 16, 2015

(86) PCT No.: PCT/US2015/050373

§ 371 (c)(1),
(2) Date: Mar. 17, 2017

(87) PCT Pub. No.: WO2016/048741

PCT Pub. Date: Mar. 31, 2016

(65) Prior Publication Data

US 2017/0247820 A1 Aug. 31, 2017

Related U.S. Application Data

(60) Provisional application No. 62/054,887, filed on Sep. 24, 2014.

(51) Int. Cl.
*D03D 1/00* (2006.01)
*D03D 11/02* (2006.01)
(Continued)

(52) U.S. Cl.
CPC ..... *D03D 1/0088* (2013.01); *D03D 11/02* (2013.01); *D03D 15/593* (2021.01);
(Continued)

(58) Field of Classification Search
CPC .... D03D 11/02; D03D 1/0088; D03D 25/005; D03D 15/02; H01H 2221/04;
(Continued)

(56) References Cited

U.S. PATENT DOCUMENTS 3,617,666 A 11/1971 Braue
3,681,724 A * 8/1972 Shepard ..... H01H 36/004 335/207
(Continued)

FOREIGN PATENT DOCUMENTS

CN 1650057 A 8/2005
CN 1650378 A 8/2005
(Continued)

*Primary Examiner* — Jennifer A Steele
(74) *Attorney, Agent, or Firm* — Treyz Law Group, P.C.; G. Victor Treyz; Kendall P. Woodruff

(57) ABSTRACT

Three-dimensional weaving, knitting, or braiding tools may be used to create three-dimensional fabric (24) with internal pockets (56). The pockets (56) may be shaped to receive electrical components such as switch electrodes (46A, 46B) for a switch (18). The fabric (24) may have adjacent first and second layers that are interposed between the switch electrodes (46A, 46B). The switch electrodes (46A, 46B) may be biased apart using magnets (46A-1, 46B-1) or other biasing structure. In a region of the fabric (24) that overlaps the first and second switch electrodes (46A, 46B), the first and second layers of fabric may be disconnected from each other. This allows the first and second layers to pull away from each other so that the electrodes (46A, 46B) are separated by the biasing force from the biasing structure. The switch (18) can be closed by pressing the electrodes (46A, 46B) together.

14 Claims, 10 Drawing Sheets

(51) Int. Cl.
*D03D 15/593* (2021.01)
*D03D 25/00* (2006.01)
*H01H 13/702* (2006.01)

(52) U.S. Cl.
CPC ..... *D03D 25/005* (2013.01); *D10B 2401/18* (2013.01); *D10B 2403/023* (2013.01); *H01H 13/702* (2013.01); *H01H 2203/0085* (2013.01); *H01H 2221/04* (2013.01)

(58) Field of Classification Search
CPC ..... H01H 2203/0085; H01H 13/702; D10B 2401/18; D10B 2403/023; D10B 2403/02431; H01R 13/00; H01R 2201/12
See application file for complete search history.

(56) References Cited

U.S. PATENT DOCUMENTS 4,796,631 A * 1/1989 Grigoryev ..... A61F 5/0123 602/2
5,572,401 A * 11/1996 Carroll ..... G06F 1/163 361/679.03
7,836,917 B1 * 11/2010 Osborne ..... D03D 25/005 139/11
2003/0211797 A1 * 11/2003 Hill ..... D03D 1/0088 442/205
2006/0071751 A1 * 4/2006 Wagner ..... H01H 13/702 338/47
2006/0254899 A1 * 11/2006 Bieck ..... H01H 13/702 200/511
2006/0281382 A1 * 12/2006 Karayianni ..... D04B 1/14 442/181
2010/0315299 A1 12/2010 Bibl et al.
2013/0208938 A1 * 8/2013 Midha ..... A41D 1/002 381/333
2013/0334202 A1 * 12/2013 Li ..... A61F 7/007 219/500
2015/0181692 A1 * 6/2015 Jezewski ..... H05K 1/0393 361/679.03
2015/0188340 A1 * 7/2015 Edwards ..... H01M 10/46 320/103

FOREIGN PATENT DOCUMENTS

CN 102804811 A 11/2012
GB 2461712 1/2010
KR 100791974 1/2008

* cited by examiner

THREE-DIMENSIONAL FABRIC WITH EMBEDDED INPUT-OUTPUT DEVICES

This application claims priority to U.S. provisional patent application No. 62/054,887 filed on Sep. 24, 2014, which is hereby incorporated by reference herein in its entirety.

BACKGROUND

This relates generally to fabric-based electronic structures, and, more particularly, to incorporating input-output devices into fabric.

Fabric can be provided with metal wires and other conductive fibers. These fibers can be used to carry signals for electrical components. Fabric with conductive fibers and electrical components can be used in forming fabric-based electrical items.

Challenges may arise when forming fabric having electrical components. Unless care is taken, components may not be satisfactorily aligned and may not interact properly. Stresses on the fabric have the potential to dislodge components and short circuits can develop if signal paths are not properly isolated.

It would be desirable to be able to address these concerns by providing improved techniques for mounting electrical components in fabric to form input-output devices.

SUMMARY

Three-dimensional weaving, knitting, or braiding tools may be used to create three-dimensional fabric with internal pockets. The pockets may be shaped to receive electrical components such as switch electrodes for a switch or components for other input-output devices.

The fabric may have adjacent first and second layers that are interposed between the switch electrodes. The switch electrodes may be biased apart using magnets or other biasing structures. In a region of the fabric that overlaps the first and second switch electrodes, the first and second layers of fabric may be disconnected from each other. This allows the first and second layers to pull away from each other so that the electrodes become separated by the biasing force from the biasing structure. A user can close the switch by pressing the electrodes together.

The switch electrodes or components for other input-output devices may be formed in fabric that forms a housing for an electronic device, in fabric that forms an accessory with an interior region that is shaped to receive an electronic device, in fabric in an embedded system, in or other fabric structures.

DETAILED DESCRIPTION

Electrical components may be incorporated into the fabric to form input-output devices such as switches and other devices. The fabric may form part of an electronic device such as a cellular telephone, tablet computer, watch, or other stand-alone electronic device, may form part of a case, cover, or other fabric-based electronic device of the type that may serve as an accessory for a stand-alone electronic device, or may be formed as part of an embedded system or other fabric-based item.

An electronic device that contains fabric may be an accessory for a cellular telephone, tablet computer, wrist-watch device, laptop computer, or other electronic equipment. For example, the electronic device may be a removable external case for stand-alone electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating, may be part of an item of clothing, or may be any other suitable fabric-based item. If desired, the fabric may be used in forming part of an electronic device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric-based equipment is mounted in a kiosk, in an automobile or other vehicle, equipment that implements the functionality of two or more of these devices, or other electronic equipment.

The fabric in which one or more input-output devices has been incorporated may form all or part of an electronic device, may form all or part of a housing wall for an electronic device, may form internal structures in an electronic device, or may form other fabric-based structures. The fabric-based device may be soft (e.g., the device may have a fabric surface that yields to a light touch), may have a rigid feel (e.g., the surface of the device may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

Figure 1:
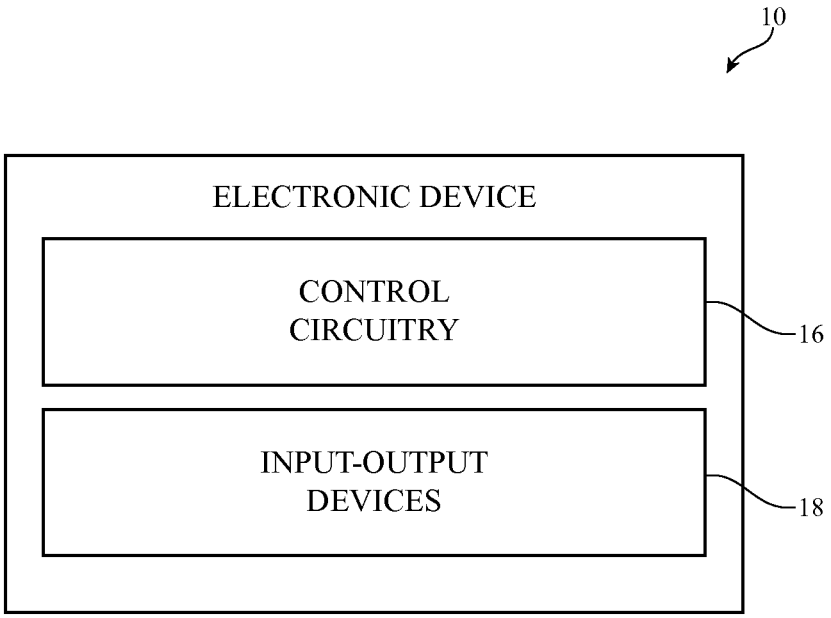
FIG. 1 is a schematic diagram of an illustrative electronic device in accordance with an embodiment.

A schematic diagram of an illustrative electronic device is shown in FIG. 1. Device 10 may be a stand-alone electronic device, may be an accessory that operates in conjunction with a stand-alone electronic device, or may be other electronic equipment. As shown in FIG. 1, electronic device 10 may have control circuitry 16. Control circuitry 16 may include storage and processing circuitry for supporting the operation of device 10. The storage and processing circuitry may include storage such as hard disk drive storage, non-volatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors and other wireless communications circuits, power management units, audio chips, application specific integrated circuits, etc.

Input-output circuitry in device 10 such as input-output devices 18 may be used to allow data to be supplied to device 10 and to allow data to be provided from device 10 to external devices. During operation, control circuitry 16 may use input-output devices 18 to gather input from a user, external equipment, and/or the environment around device 10. Control circuitry 16 may also use input-output devices 18 to provide output to a user or external equipment.

Input-output devices 18 may include switches, buttons, joysticks, scrolling wheels, touch pads, key pads, keyboards, microphones, speakers, tone generators, vibrators, cameras, sensors such as touch sensors, capacitive proximity sensors, light-based proximity sensors, ambient light sensors, compasses, gyroscopes, accelerometers, moisture sensors, force sensors, light-emitting diodes and other status indicators, data ports, displays, and other input-output devices.

Input-devices 18 may be formed from components such as conductive fabric portions, electrodes for a capacitive sensor or other device, sensor structures, structures such as switch electrodes, connector structures, wires or other conductive fibers, printed circuits, metal structures, plastic parts, other component structures, and combinations of these structures. Internal pockets, seams, and other structures may be produced in fabric to help accommodate components such as these and thereby incorporate input-output devices 18 for device 10 into the fabric.

Control circuitry 16 may be used to run software on device 10 such as operating system code and applications. During operation of device 10, the software running on control circuitry 16 may use input-output devices 18 to gather input and supply output. Control circuitry 16 may, for example, monitor sensors, switches, buttons, or other components to determine whether a user is supplying input to device 10 and/or to monitor the environment of device 10 (e.g., to determine whether a component has been placed inside a case, bag, or other fabric receptacle, to determine whether a strap or band or other portion of a device is being held by a user, to determine whether a headset or other accessory is in place on a user's head or other body part, etc.). When appropriate, control circuitry 16 may direct input-output devices 18 to provide visual output, audio output, vibrating output and other mechanical output, digital and/or analog signal output, and other output from device 10.

Figure 2:
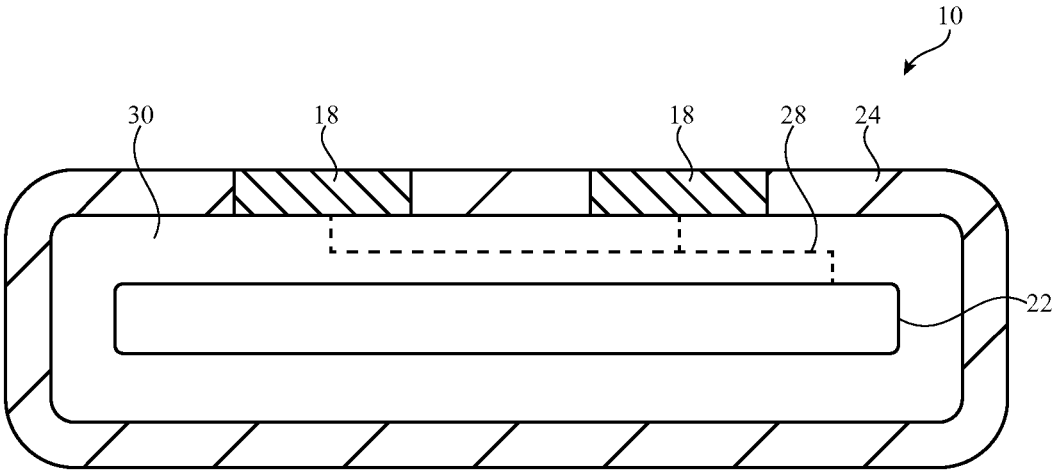
FIG. 2 is a cross-sectional side view of illustrative fabric-based structures into which input-output devices have been incorporated in accordance with an embodiment.

A cross-sectional side view of an illustrative electronic device is shown in FIG. 2. Device 10 of FIG. 2 may have fabric-based structures 24. One or more input-output devices 18 may be incorporated into fabric-based structures 24. Control circuitry 16 may also be incorporated into fabric structures 24 and/or housed within interior region 30 of fabric structures 24. As shown in FIG. 2, signal paths such as signal path 28 may be used to couple input-output devices 18 to circuitry 22 in interior 30 of structures 24. Circuitry 22 may include control circuitry and/or input-output devices.

With one suitable arrangement, device 10 of FIG. 2 is a stand-alone electronic device (e.g., a cellular telephone, watch, tablet computer, laptop computer, etc.) and fabric structures 24 form some or all of the exterior of device 10. Fabric structures 24 may, for example, form some or all of a housing for device 10. In this type of scenario, the housing for device 10 may have one or more interior regions such as interior region 30 that encase internal components such as circuitry 22. Circuitry 22 may include integrated circuits and other components for forming processing circuitry 16 and input-output devices 18 and may include other circuitry. If desired, fabric-based structures 24 may be used in forming items such as clothing items, furniture items, parts of an embedded system in an automobile or airplane, furniture, or other fabric-based items.

With another suitable arrangement, device 10 of FIG. 2 uses structures 24, input-output devices 18, and other circuitry 16 and devices 18 to form an accessory or other device or to form fabric in an embedded system. Structures 24 may, for example, be used in forming a removable case, cover, or bag that has an interior 30 that is configured to receive a stand-alone device (i.e., circuitry 22 in this scenario may be a stand-alone device such as a cellular telephone, watch, tablet computer, laptop computer, etc.). Path 28 in this scenario may be a wired or wireless path that couples device 10 to the circuitry of fabric-based structures 24 such as input-output devices 18, control circuitry 16, and other circuitry associated with fabric-based structures 24.

Figure 3:
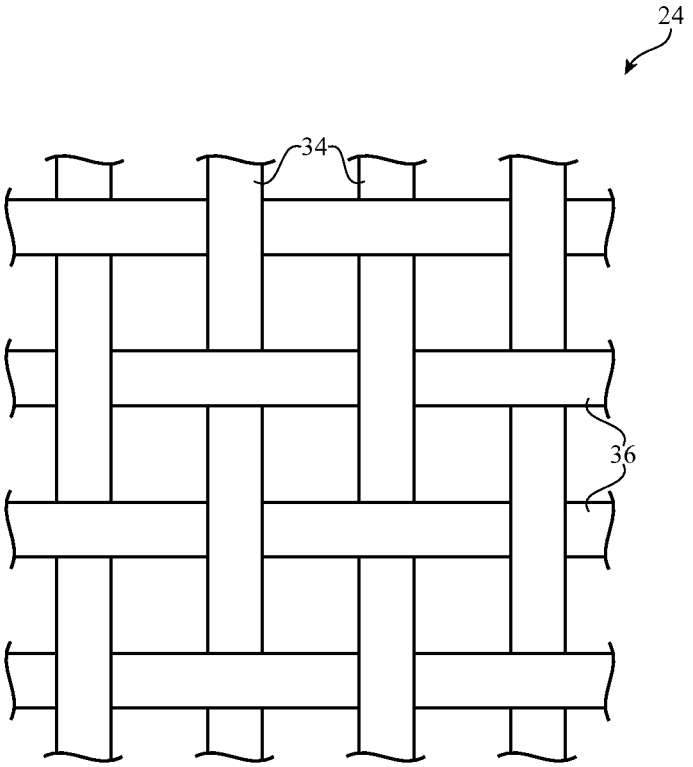
FIG. 3 is a top view of an illustrative fabric in accordance with an embodiment.

FIG. 3 is a diagram of illustrative fabric that may be used in forming fabric structures 24 of FIG. 3. In the example of FIG. 3, fabric 24 is woven fabric having warp fibers 34 and weft fibers 36. In the top view of FIG. 3, only a single layer of fabric 24 is visible. Fabric 24 preferably contains multiple layers of fabric woven to form a three-dimensional fabric structures. Other fiber intertwining techniques (e.g., three-dimensional knitting or braiding) may be used in forming fabric structures 24 with multiple layers, if desired. The example of FIG. 3 is merely illustrative.

Figure 4:
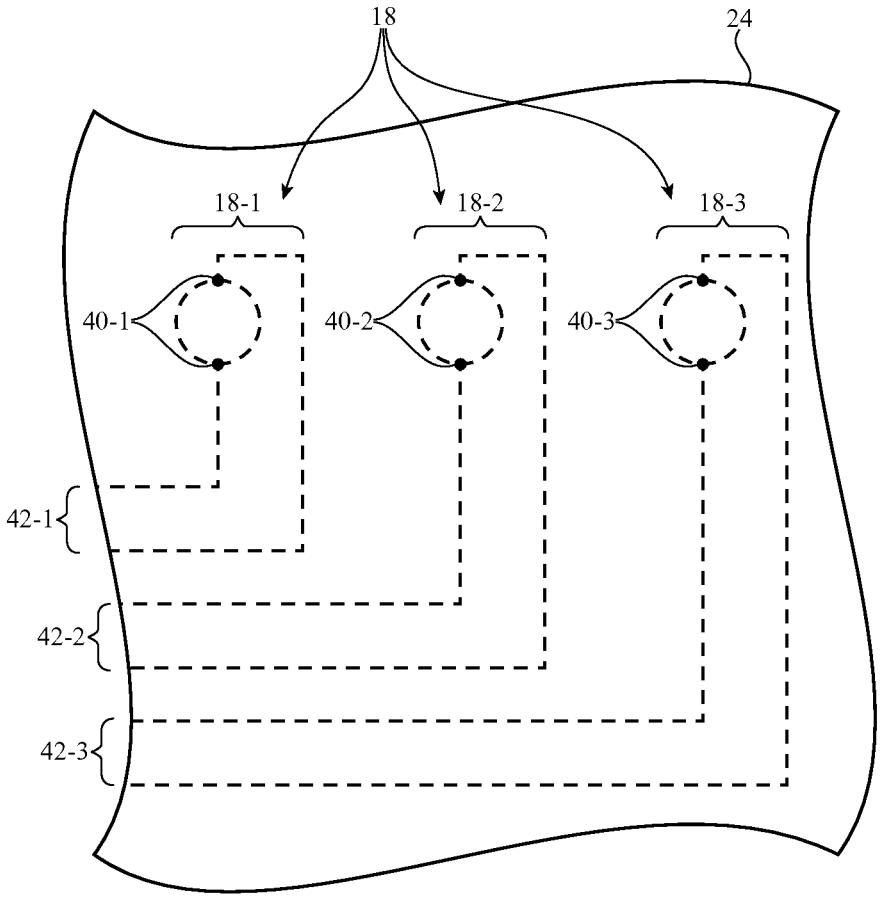
FIG. 4 is a top view of a portion of a fabric into which three input-output devices have been incorporated in accordance with an embodiment.

FIG. 4 is a top view of fabric 24 in a configuration in which three input-output devices 18 have been incorporated into fabric 24. Input-output device 18-1 may have terminals 40-1 that are coupled to signal path 42-1, input-output device 18-2 may have terminals 40-2 that are coupled to signal path 42-2, and input-output device 18-3 may have terminals 40-3 may have terminals that are coupled to signal path 42-3. Conductive lines in paths 42-1, 42-2, and 42-3 may be formed from conductive fibers, metal traces in printed circuits, and other conductive signal path structures and can convey signals between input-output devices 18 and control circuitry 16. As an example, input-output devices 18 may be buttons that are open and closed in response to user button presses and/or switches that serve as sensors to determine whether force is being exerted on a portion of fabric 24. In this type of configuration, control circuitry 16 may use signal paths 42-1, 42-2, and 42-3 to monitor the states of input-output devices 18 so that appropriate action can be taken in response to detecting that switch electrodes have come into contact with each other (i.e., that the switch in a button or sensor has been closed due to external forces).

Figure 5:
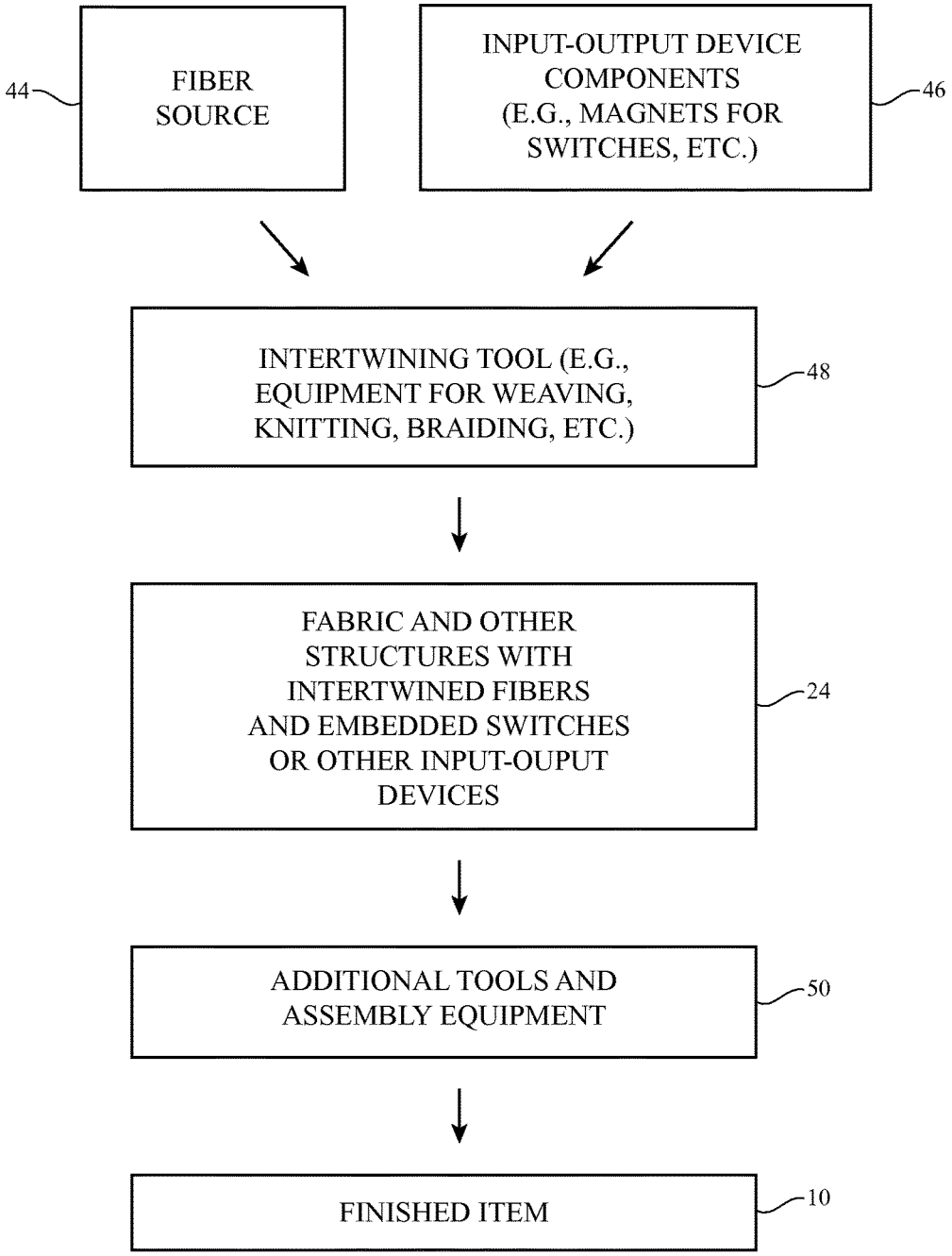
FIG. 5 is a diagram of illustrative equipment for forming fabric-based structures with input-output devices in accordance with an embodiment.

Illustrative equipment and operations of the type that may be involved in forming fabric-based items that include electrical components (e.g., components for forming one or more input-output devices 18 in fabric 24) are shown in FIG. 5.

As shown in FIG. 5, the equipment of FIG. 5 may be provided with fibers from fiber source 44. The fibers provided by fiber source 44 may be single-strand filaments or may be threads, yarns, or other fibers that have been formed by intertwining single-strand filaments. Fibers may be formed from polymer, metal, glass, graphite, ceramic, natural materials such as cotton or bamboo, or other organic and/or inorganic materials and combinations of these materials. Conductive coatings such as metal coatings may be formed on non-conductive fiber cores. Fibers may also be formed from single filament metal wire or stranded wire. Fibers may be insulating or conductive. Fibers may be conductive along their entire length or may have conductive segments (e.g., metal portions that are exposed by locally removing polymer insulation from an insulated conductive fiber). Threads and other multi-strand fibers that have been formed from intertwined filaments may contain mixtures of conductive fibers and insulating fibers (e.g., metal fibers or metal coated fibers with or without exterior insulating layers may be used in combination with solid plastic fibers or natural fibers that are insulating).

The fibers from fiber source 44 may be intertwined using intertwining equipment 48 to produce fabric 24. Equipment 48 may include weaving tools (e.g., a rapier needle machine, a needle weaving machine, a shuttle weaving machine, etc.), knitting tools, tools for forming braided fabric, or other equipment for intertwining the fibers from source 44. Equipment 48 may be automated. For example, equipment 48 may include computer-controlled actuators that manipulate and intertwine fibers from source 44. Intertwining equipment 48 may be configured to produce three-dimensional fabric structures (e.g., fabrics with potentially complex multi-layer structures). For example, intertwining equipment 48 may include a three-dimensional weaving machine, knitting equipment that produces three-dimensional structures, tools for producing three-dimensional braided fabrics, etc.

Input-output device components 46 may be used to create input-output devices 18 in fabric 24. Components 46 may include switch electrodes (e.g., switch electrodes that are biased apart using magnets), metal structures, plastic structures, ceramic structures, glass structures, magnetic structures, and structures formed from other materials that can be used to create input-output devices such as buttons, joysticks, scrolling wheels, touch pads, key pads, keyboards, microphones, speakers, tone generators, vibrators, cameras, sensors such as touch sensors, capacitive proximity sensors, light-based proximity sensors, ambient light sensors, compasses, gyroscopes, accelerometers, moisture sensors, force sensors, light-emitting diodes and other status indicators, data ports, displays, and other input-output devices. Components 46 may be incorporated into fabric 24 using equipment 48, using other computer-controlled assembly equipment (e.g., computer-controlled positioners and other robotic equipment), and/or using manual fabrication techniques.

As shown in FIG. 5, fabric 24 that includes embedded components 46 for forming switches for buttons or force sensors and other input-output devices 18 may be processed using additional tools and assembly equipment 50. For example, fabric 24 may be attached to housing structures formed from plastic, metal, glass, or other materials using adhesive, fasteners, or other attachment techniques, fabric 24 may be sewn, cut, and otherwise incorporated into fabric-based items, fabric 24 may be formed into structures with cavities that are filled with foam, circuitry, and other items, and input-output devices 18, circuitry 16, and/or other structures may be assembled with fabric 24 to form a finished fabric-based item (e.g., electronic device 10).

Figure 6:
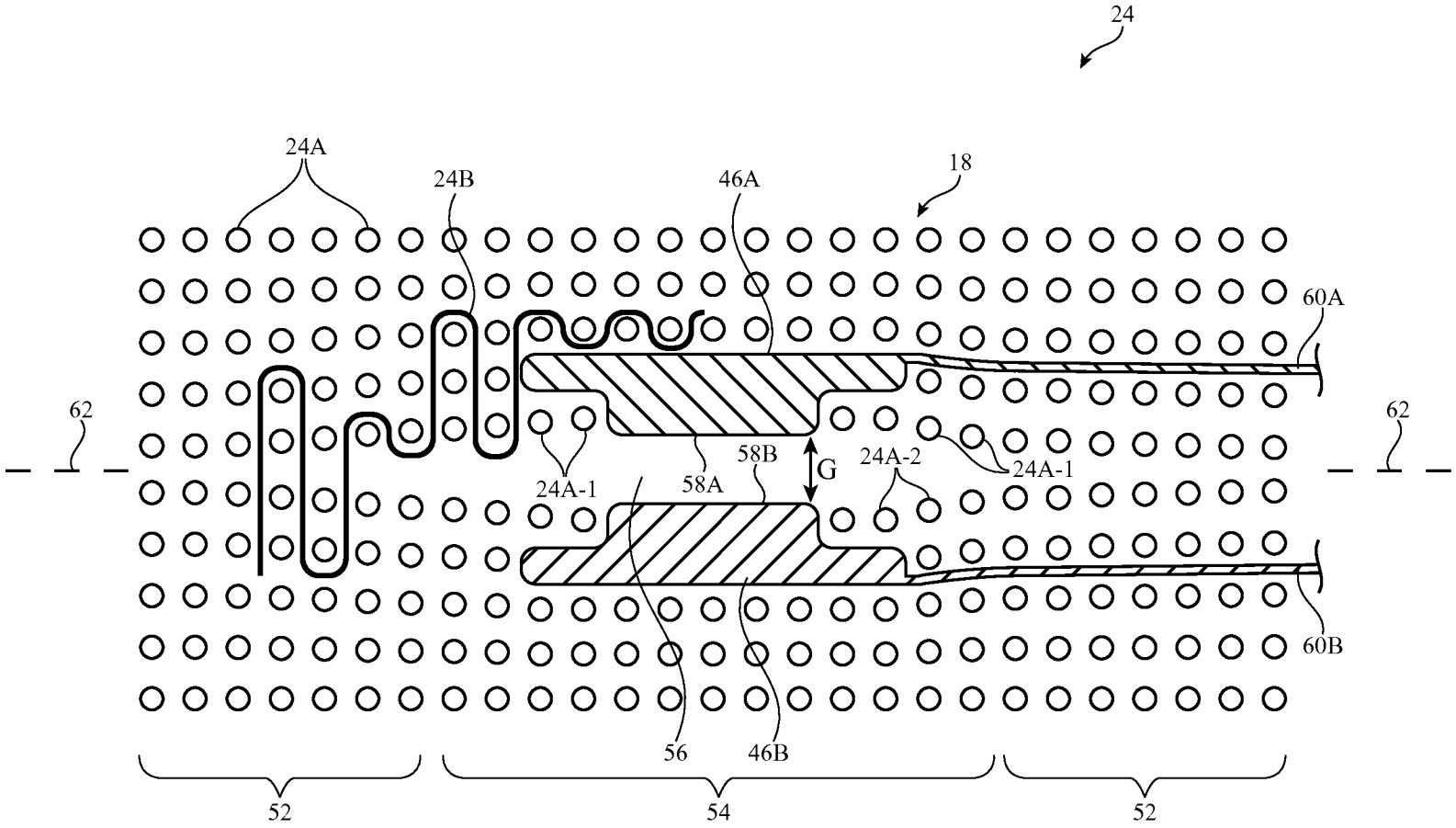
FIG. 6 is a cross-sectional side view of an illustrative input-output device such as a switch that has been incorporated into a fabric in accordance with an embodiment.

FIG. 6 is a cross-sectional side view of an illustrative portion of fabric 24 into which components 46A and 46B have been incorporated to form input-output device 18. In the example of FIG. 6, fabric 24 has fibers such as fibers 24A and 24B. Fibers 24A may be warp fibers and fibers 24B may be weft fibers (or vice versa). Fibers 24A and 24B may be woven into a three-dimensional fabric (as an example). Fibers 24A extend into and out of the page in the orientation of FIG. 6. Numerous additional fibers 24B (e.g., additional fibers lying in the page in the orientation of FIG. 6) may be intertwined with fibers 24A to hold fabric 24 together. A single illustrative fiber 24B is shown in FIG. 6 to avoid over-complicating the drawing.

By appropriately configuring intertwined fibers such as fiber 24B, interior cavities (sometimes referred to as pockets or woven pockets) may be formed for components 46A and 46B. Components 46A and 46B may be embedded within fabric 24 by intertwining the fibers of fabric 24 around components 46A and 46B (e.g., by forming the pockets for components 46A and 46B while components 46A and 46B are in place within fabric 24) or components 46A and 46B may be installed within pockets that have been previously formed within fabric 24. Components 46A and 46B may form switch electrodes in a switch-based sensor or a button containing a switch and, if desired, may include magnets to bias components 46A and 46B apart when not being subjected to external force or pressed by a user. Arrangements in which components 46A and 46B form other input-output devices 18 may also be used. The use of switch electrodes to form a switch for a switch sensor or button is sometimes described herein as an example.

In regions of fabric 24 such as region 52, fibers 24A and 24B are woven or otherwise intertwined with each other so that fabric 24 is solid. Fibers 24A above and below plane 62 are attached together so that fibers 24A cannot be separated in regions 52. Fabric 24 in regions 52 may, for example, have multiple layers of fibers 24A in which each given layer of fibers 24A is attached to layers of fibers 24A above and below that given layer. Because fabric 24 is solid in regions 52, the layers of fabric 24 will not pull apart in regions 52.

In regions of fabric such as region 54, however, fibers such as fibers 24A-1 in a layer of fabric associated with component 46A are not directly attached to fibers such as fibers 24A-2 in an immediately adjacent layer of fabric that is associated with component 46B. As a result, of the separation of the fibers of layers 24A-1 and 24A-2 from each other in region 54, the layers of fabric 24 that are formed from fibers 24A-1 and 24A-2 will separate from each other when components 46A and 46B are biased away from each other.

Components 46A and 46B may, as an example, have permanent magnets with opposing poles that drive components 46A and 46B apart from each other. The lack of fiber 24B that joins fibers 24A-1 to fibers 24A-2 in region 54 allows interior opening 56 to develop (i.e., the layer of fabric containing upper fibers 24A-1 separates away from the layer of fabric containing adjacent lower fibers 24A-2). As opening 56 develops, a gap such as gap G may appear between opposing adjacent surfaces of components 56A and 46B. In particular, surface 58A of component 46A and mating surface 58B of component 46B will become separated and will not be in contact with each other. As the layers of fabric that are formed from fibers 24A-1 and 24A-2 separate from each other along separation plane 62, gap G will become sufficiently large to ensure that component 46A does not contact and electrically connect with component 46B. The size of gap G may be 0.1 mm to 5 mm, may be more than 0.05 mm, may be less than 1 cm, may be 0.2 to 3 mm, or may be any other suitable size.

Components 46A and 46B may include magnets with opposing poles that drive components 46A and 46B apart when the switch formed from components (switch electrodes) 46A and 46B is not being pressed by a user. Surfaces 58A and 58B may be conducting and may be electrically coupled to respective conductive paths such as paths 60A and 60B. Paths 60A and 60B may be conducting fibers (e.g., fibers that are used in forming fabric 24) or may be separate wires, metal traces in printed circuits, or other conductive paths. Solder, welds, conductive adhesive, or other conductive materials may be used in attaching path 60A to component 46A and in attaching path 60B to component 46B. The pockets that are used to hold components 46A and 46B may have circular footprints (e.g., the pockets may have the shape of thin cylindrical disks and may be circular when each input-output device 18 is viewed from above as in FIG. 4), may have rectangular footprints, may have outlines with curved and straight edges, or may have other suitable shapes.

With configurations of the type shown in FIG. 6, components 46A and 46B may form a switch. When components 46A and 46B are separated from each other by gap G, an open circuit will be formed between conductive lines 60A and 60B (i.e., the switch formed from components 46A and 46B will be in an open state). When external force is applied that brings components 46A and 46B together, surfaces 58A and 58B will come into electrical contact with each other and will thereby place the switch in a closed state. In the closed state, conductive lines 60A and 60B will be shorted together.

Figure 7:
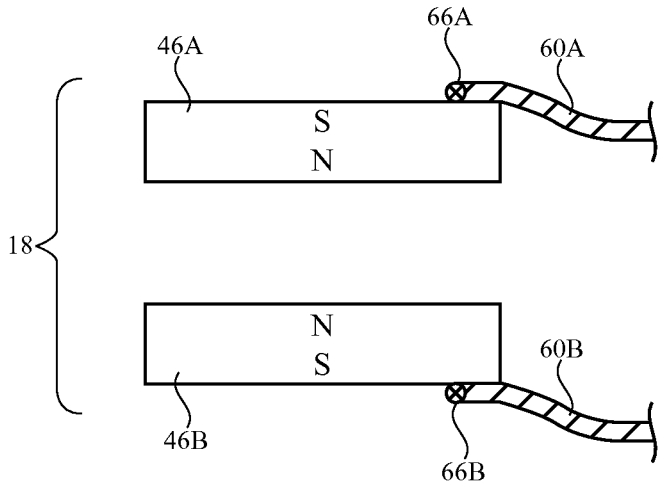
FIG. 7 is a cross-sectional side view of an illustrative input-output device such as a switch having a pair of magnets that may be incorporated into fabric in accordance with an embodiment.

An illustrative configuration in which components 46A and 46B are magnets that form a switch is shown in FIG. 7. In the example of FIG. 7, input-output device 18 is a switch having open and closed positions. Magnet 46A has a south pole that faces up and a north pole that face down and is electrically coupled to line 60A using conductive material 66A (e.g., solder, a weld, conductive adhesive, etc.). Magnet 46B has a magnetic field that runs in the opposite direction as that of component 46A because the south pole of magnet 46B faces down and the north pole of magnet 46B faces up. With this configuration, magnets 46A and 46B repel each other and place switch 18 into an open state. When sufficient external force is applied that presses magnets 46A and 46B together, magnets 46A and 46B will come into contact with each other. Magnets 46A and 46B may be formed from a conductive material such as a ferrite material or other electrically conductive magnetic material, so that lines 60A and 60B will be shorted together when magnets 46A and 46B touch each other.

Figure 8:
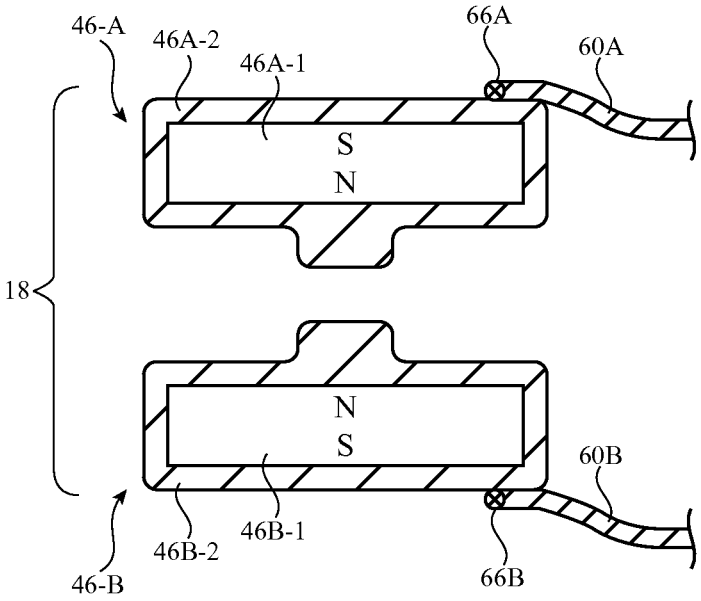
FIG. 8 is a cross-sectional side view of an illustrative input-output device having a pair of magnets with surrounding support structures that may be incorporated into fabric in accordance with an embodiment.

In the illustrative configuration of FIG. 8, components 46A and 46B are covered with metal cases or other conductive coatings or structures that fully or partly cover the surfaces of underlying magnets. Component 46A has magnet 46A-1. Component 46B has magnet 46B-1. The poles of magnets 46A-1 and 46B-1 are aligned and oppose each other so that magnets 46A-1 and 46B-1 repel each other. Magnet 46A-1 may be covered with conductive structure 46A-2 (e.g., a metal structure) and magnet 46B-1 may be covered with conductive structure 46B-2 (e.g., a metal structure), so that switch 18 will be closed when components 46A and 46B are brought into contact with each other.

Figure 9:
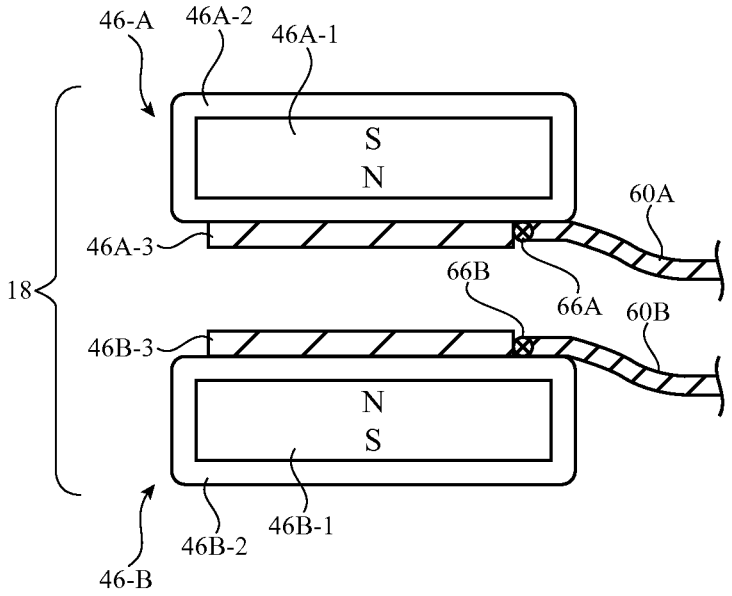
FIG. 9 is a cross-sectional side view of an illustrative input-output device having a pair of contacts or other structures that are biased apart using magnets and that may be incorporated into fabric in accordance with an embodiment.

FIG. 9 is a side view of switch 18 in a configuration in which components 46A and 46B have been provided with individual contacts such as contacts 46A-3 and 46B-3. Contacts 46A-3 and 46B-3 may, for example, be formed from metal. Structure 46A-2 may partly or completely surround magnet 46A-1. Structure 46B-2 may partly or completely surround magnet 46B-1. Structures 46A-2 and 46B-2 may be formed from plastic, metal, ceramic, or other suitable materials. Contacts 46A-3 and 46B-3 may be attached to structures 46A-2 and 46B-2 using welds, adhesive, fasteners, or other attachment mechanisms. Magnets 46A-1 and 46B-1 may have opposing magnetic fields, so that components 46A and 46B are biased away from each other to create a normally open state for switch 18.

Figure 10:
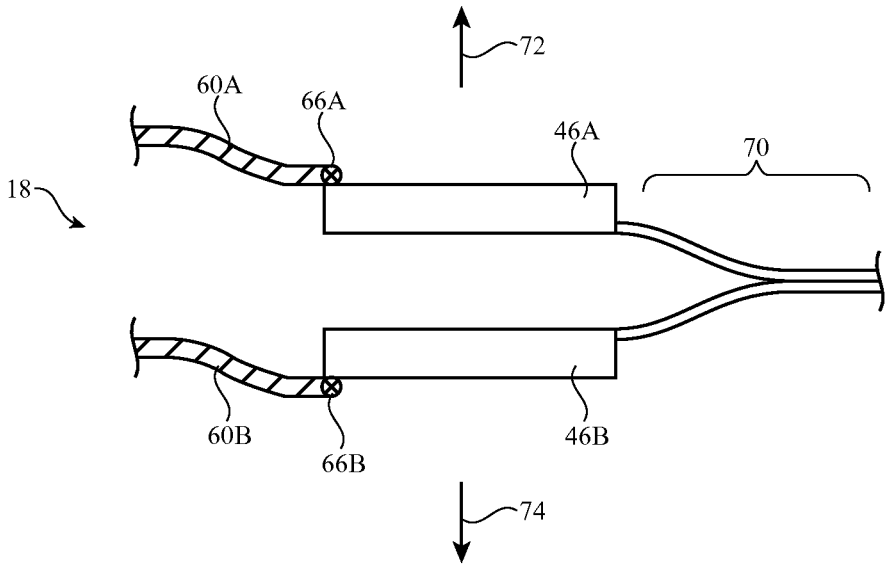
FIG. 10 is a cross-sectional side view of an illustrative input-output device having a pair of structures that are biased apart using a mechanical biasing structure and that may be incorporated into fabric in accordance with an embodiment.

In the arrangement of FIG. 10, components 46A and 46B are being biased away from each other by biasing structure 70. Biasing structure 70 may be formed using one or more springs, foam, or other mechanical structure for biasing component 46A upwards in direction 72 while biasing component 46B downwards in direction 74. Components 46A and 46B may have conductive contacts that short signal paths 60A and 60B together when components 46A and 46B are pressed together within switch 18. If desired, components 46A and 46B may have other structures for forming switch 18. For example, components 46A and 46B may be capacitor electrodes (e.g., to form a capacitive switch 18 in a scenario in which circuitry 16 monitors capacitance chances on paths 60A and 60B), may be force sensors that measure a range of different force values, strain gauges, temperature sensors, light-based sensors, or other electrical components that operate together to implement the functions of switch 18.

Input-output devices that are incorporated into fabric 24 may be based on sensors, switches for buttons, may be output devices, or may be any other suitable electronic devices. Configurations in which input-output devices 18 in fabric 24 are switches have been described herein as an example. If desired, other electrical components can be mounted in hollow pockets woven or otherwise formed within a three-dimensional fabric. Optional internal cavities such as cavity 56 of FIG. 6 may be formed by creating planar disconnected regions between adjacent layers of fabric 24. These disconnected regions (i.e., areas in which fibers such as fibers 24A-1 and 24A-2 in first and second respective adjacent layers are not woven directly together or are otherwise disconnected from each other and therefore free to pull away from each other) may overlap components 46A and 46B and may be interposed between components 46A and 46B and/or may be formed at other suitable locations within fabric 24.

In accordance with an embodiment, apparatus is provided that includes fabric that is formed from fibers that are intertwined to form first and second internal pockets, and an input-output device having a first component in the first pocket and a second component in the second pocket, the fabric has first and second adjacent layers that are interposed between the first and second components and that are not connected to each other in an area overlapping the first and second components.

In accordance with another embodiment, the first component includes a magnet.

In accordance with another embodiment, the second component includes a magnet that repels the magnet of the first component.

In accordance with another embodiment, the input-output device is a switch that is closed when the first and second magnets contact each other.

In accordance with another embodiment, the apparatus includes first and second conductive paths coupled respectively to the first and second magnets.

In accordance with another embodiment, the fabric is a three-dimensional woven fabric.

In accordance with another embodiment, the fabric forms a removable case for an electronic device and has an interior cavity that accommodates an electronic device selected from the group consisting of a cellular telephone, a watch, a tablet computer, and a laptop computer.

In accordance with another embodiment, the apparatus includes a biasing structure that biases the first and second components away from each other.

In accordance with another embodiment, the biasing structure includes a spring.

In accordance with another embodiment, the fabric forms at least part of a housing for an electronic device, the apparatus includes control circuitry mounted within an interior region defined by the housing.

In accordance with an embodiment, an electronic device is provided that includes a fabric having a shape that defines an interior region, a switch formed from first and second switch electrodes in the fabric, fabric has a first pocket in which the first electrode is located and has a second pocket in which the second electrode is located, and control circuitry mounted in the interior region that monitors the switch.

In accordance with another embodiment, the fabric is a three-dimensional woven fabric having fibers that are woven to create the first and second pockets.

In accordance with another embodiment, the fabric has layers, the layers include a first layer interposed between the first and second pockets and include a second layer between the first and second pockets.

In accordance with another embodiment, the electronic device includes a disconnected area between the first and second layers that overlaps the first and second switch electrodes, the disconnected area allows the first and second switch electrodes to move away from each other to create an internal cavity between the first and second switch electrodes.

In accordance with another embodiment, the first switch electrode has a first magnet and the second switch electrode has a second magnet that repels the first magnet so that the switch is normally open.

In accordance with an embodiment, an accessory for an electronic device is provided that includes a fabric having a shape that defines an interior region that receives the electronic device, a switch formed from first and second switch electrodes in the fabric, fabric has a first pocket in which the first electrode is located and has a second pocket in which the second electrode is located, and control circuitry mounted in the interior region that monitors the switch.

In accordance with another embodiment, the fabric is a three-dimensional woven fabric having warp and weft fibers that are woven to create the first and second pockets.

In accordance with another embodiment, the fabric has layers, the layers include a first and second adjacent layers that are interposed between the first and pocket and the second pocket and the first and second adjacent layers have an area that is disconnected to allow the first and second adjacent layers to separate from each other and form a cavity in the fabric between the first and second switch electrodes.

In accordance with another embodiment, the accessory includes a biasing structure that biases the first and second switch electrodes away from each other.

In accordance with another embodiment, the biasing structure includes a first magnet attached to the first switch electrode and a second magnet attached to the second switch electrode.

The foregoing is merely illustrative and various modifications can be made by those skilled in the art without departing from the scope and spirit of the described embodiments. The foregoing embodiments may be implemented individually or in any combination.

What is claimed is:

1. Apparatus, comprising:

a three-dimensionally woven fabric that is formed from fibers that are intertwined to form first and second internal pockets; and an input-output device having a first magnet in the first pocket and a second magnet in the second pocket, wherein the fabric has first and second adjacent layers that are not connected to each other in an area overlapping the first and second magnets and wherein the first and second magnets include switch electrodes that are separated from one another by a gap created by a repelling force between the first and second magnets.

2. The apparatus defined in claim 1 wherein the input-output device is a switch that is closed when the first and second magnets contact each other.

3. The apparatus defined in claim 2 further comprising first and second conductive paths coupled respectively to the first and second magnets.

4. The apparatus defined in claim 3 wherein the fabric is a three-dimensional woven fabric.

5. The apparatus defined in claim 1 wherein the fabric forms at least part of a housing for an electronic device, the apparatus further comprising control circuitry mounted within the housing.

6. An electronic device, comprising:

a three-dimensionally woven a fabric having first and second fabric layers, a first pocket in the first fabric layer, and a second pocket in the second fabric layer;

a first magnet in the first pocket that includes a first switch electrode;

a second magnet in the second pocket that includes a second switch electrode, the first and second switch electrodes forming a switch;

a gap between the first and second fabric layers that is created by a repelling force between the first and second magnets; and control circuitry that monitors the switch.

7. The electronic device defined in claim 6 wherein the fabric is a three-dimensional woven fabric having fibers that are woven to create the first and second pockets.

8. The electronic device defined in claim 7 further comprising a disconnected area between the first and second fabric layers that overlaps the first and second switch electrodes, wherein the disconnected area allows the first and second switch electrodes to move away from each other to create the gap between the first and second fabric layers.

9. The electronic device defined in claim 6 wherein the control circuitry monitors the switch to detect when the first and second switch electrodes come into contact with each other.

10. The electronic device defined in claim 6 wherein the fabric comprises warp strands and weft strands and wherein the first and second pockets each overlap a plurality of warp strands and a plurality of weft strands.

11. The electronic device defined in claim 10, wherein the first and second pockets have cylindrical disk shapes.

12. An accessory for an electronic device, comprising:

a three-dimensionally woven a fabric having first and second pockets;

a first magnet in the first pocket and a second magnet in the second pocket that repel one another to create a gap between the first and second pockets;

a switch formed from a first switch electrode on the first magnet and a second switch electrode on the second magnet; and control circuitry that monitors the switch.

13. The accessory defined in claim 12 wherein the fabric is a three-dimensional woven fabric having warp and weft fibers that are woven to create the first and second pockets.

14. The accessory defined in claim 13 wherein the fabric has layers, wherein the layers include first and second adjacent layers that are connected to one another in a first region of the fabric and disconnected from one another in a second region of the fabric to allow the first and second adjacent layers to separate from each other to create the gap between the first and second pockets.

* * * * *